US005884879A

United States Patent [19]

Gruenenfelder

[11] Patent Number: 5,884,879

[45] Date of Patent: Mar. 23, 1999

[54] ERGONOMIC SUPPORT PAD

[76] Inventor: Marc A. Gruenenfelder, 220 A1 Harvey Rd., Stonington, Conn. 06378

[21] Appl. No.: 909,835

[22] Filed: Aug. 12, 1997

Related U.S. Application Data

[60] Provisional application No. 60/024,482 Aug. 23, 1996.

[51] Int. Cl.[6] ..... B68G 5/00

[52] U.S. Cl. ..... 248/118; 248/918

[58] Field of Search ..... 248/118, 118.1, 248/118.3, 118.5, 918, 911; 400/715, 718; D14/114; 108/69, 91

[56] References Cited

U.S. PATENT DOCUMENTS

| | | | |
|---|---|---|---|
| 744,287 | 11/1903 | Brasel | 248/118.3 |
| 3,300,250 | 1/1967 | Dollgener et al. | 248/118.1 |
| 5,131,614 | 7/1992 | Garcia et al. | 248/118 |
| 5,170,971 | 12/1992 | Schaeffer et al. | 248/118.1 |
| 5,195,705 | 3/1993 | Kline et al. | 248/118.3 |
| 5,342,005 | 8/1994 | Szmanda | 248/118 |
| 5,464,292 | 11/1995 | Grant | 400/715 |
| 5,492,298 | 2/1996 | Walker | 248/346.01 |
| 5,597,218 | 1/1997 | Lechman | 312/223.3 |
| 5,632,045 | 5/1997 | Chase et al. | 2/161.6 |
| 5,782,450 | 7/1998 | Spencer | 248/346.07 |

OTHER PUBLICATIONS

Materials Summary Sheet, CONFOR Foams, E–A–R Specialty Composites Div., Cabot Safety Corporation, one sheet (both sides), printed Feb. 1996.

Technical Data Sheet TDS–13, CONFOR Ergonomic Urethane Foams, E•A•R Specialty Composites Div., Cabot Safety Corp., faxed Jul. 18, 1996, 5 sheets.

*Primary Examiner*—Derek J. Berger
*Assistant Examiner*—Gwendolyn Baxter
*Attorney, Agent, or Firm*—Albert W. Hilburger

[57] ABSTRACT

An ergonomic support pad for supporting the forearm and wrist of a person operating a computer's in-out device may comprise bottom, middle, and top layers of open celled polyurethane foam material of substantially uniform thickness, preferably of the type which softens on contact with a warm surface thereby providing uniform pressure distribution and firm, yet fluid, support. The bottom layer has a bottom surface for resting on a supporting surface and the top layer has a top surface for engageably receiving the forearm and wrist of the person. Each layer exhibits different indentation force deflections, the bottom layer being firmest and the top layer being most supple. The support pad is approximately one to two inches thick, preferably four sided, and may be round or oval or of other shapes as viewed in plan. When multi-sided, it may have biased corner surfaces joining adjoining pairs of longitudinal and lateral edge surfaces. Longitudinal and lateral edge surfaces of the top layer are substantially perpendicular to the top surface and longitudinal and lateral edge surfaces of the middle and bottom layers are respectively uniformly angularly disposed with respect to the bottom surface, the bottom surface area being smaller than the top surface area. The support pad may have only two layers or more than three layers and may also be of one or more layers with each layer exhibiting a continuous gradient of values of indentation force deflections.

11 Claims, 3 Drawing Sheets

ERGONOMIC SUPPORT PAD

This application claims the benefit of U.S. Provisional Application No. 60/024,482, filed Aug. 23, 1996.

BACKGROUND OF THE INVENTION

1. Field of the Invention

The present invention relates generally to the field of computer accessories and peripheral equipment for use by computer operators and, more particularly, to an ergonomic support pad for receiving and supporting the forearm and wrist of a person operating an in-out device for a computer such as a keyboard or a mouse.

2. Description of the Prior Art

Numerous appliances are known which are pertinent to the invention at hand. One early instance is presented in U.S. Pat. No. 3,300,250 issued Jan. 24, 1967 to Dollgener et al. which discloses a cushioned arm rest for individuals whose occupations require a continuous use of their hands along the depending edge of work tables, benches, desks and the like.

U.S. Pat. No. 5,170,971 issued Dec. 15, 1992 to Schaeffer et al. discloses a wrist supporter made of polyurethane foam having an L-shape cross section which is adapted for installation along an edge of a work surface.

U.S. Pat. No. 5,195,705 issued Mar. 23, 1993 to Kline et al. discloses a microscope stand and armrest system for placement on a conventional desktop. Height adjustment and leveling feet are provided at each corner of a base plate and a top surface is hinged to the base plate for receiving a microscope and for tilting the microscope rearward toward the user to a position that allows the user to look directly forward when operating the microscope. Left and right sloping armrests which may be of polyurethane foam material are provided for placement on the desktop at each side of the microscope stand to support the user's forearms in natural positions while operating the microscope.

U.S. Pat. No. 5,342,005 issued Aug. 30, 1994 to Szmanda et al. discloses a forearm support apparatus for a keyboard operator which utilizes first and second forearm support units, each including a relatively firm base member having a tapered wall and a flat bottom wall. A complementing upper member has a similar taper and is secured to upper wall and an inverse orientation to raise the tapered wall to a top surface. The top member is formed of a highly resilient compressible material to receive the forearm which depresses the material and supports the forearm. The support units are mounted in laterally spaced relation with the tapered upper walls extending inwardly and downwardly toward each other such that the forearms are biased inwardly toward each other to restrict outward displacement. The members are formed symmetrically about a transverse plane generally parallel to the keyboard.

U.S. Pat. No. 5,492,298 issued Feb. 20, 1996 to Walker discloses an inclined mouse pad configured as a wedge, preferably molded of dense neoprene or the like, and equipped with working and decorative surfaces. When not in use, the working surface can be oriented downwardly against a table to expose the non-working surfaces to view. This protects the working surface from dust and damage from dropped objects and spills. The inclined mouse pad provides a gravity gradient in one direction, preferably the "Y" direction to give normal physiological feed back on the position of the mouse on the pad. Other advantages include ergonomic compatibility, elevation of the arm, and better control since the user pushes upward and pulls the mouse downward.

U.S. Pat. No. 5,597,218 issued Jan. 28, 1997 to Lechman discloses a wedge-like structure which is interposable between an object and its supporting substrate surface and whose thickness is adjustable for purposes of adjusting the tilt angle of the object relative to the substrate surface. The structure is comprised of a stack of generally flattened component members wherein a layer of a releasable adhesive composition is located between and bonded to adjacent component members that can have various configurations and be of a variety of compositions including rigid organic polymer foam. The wedgelike structure is said to be particularly well adapted for incorporation into a monitor support assembly that is located under a transparent window in the top portion of a work station so that the monitor tilt angle is adjustable relative to the assembly by the wedge-like structure.

It was with knowledge of the foregoing disclosures representative of the state of the art that the present invention was conceived and has now been reduced to practice.

SUMMARY OF THE INVENTION

The present invention relates to an ergonomic support pad for supporting the forearm and wrist of a person operating a computer's in-out device, and may comprise bottom, middle, and top layers of open celled polyurethane foam material of substantially uniform thickness, preferably of the type which softens on contact with a warm surface thereby providing uniform pressure distribution and firm, yet fluid, support. The bottom layer has a bottom surface for resting on a supporting surface and the top layer has a top surface for engageably receiving the forearm and wrist of the person. Each layer exhibits different indentation force deflections, the bottom layer being firmest and the top layer being most supple. The support pad is approximately one to two inches thick, preferably four sided, and may be round or oval or of other shapes as viewed in plan. When multi-sided, it may have biased corner surfaces joining adjoining pairs of longitudinal and lateral edge surfaces. Longitudinal and lateral edge surfaces of the top layer are substantially perpendicular to the top surface and longitudinal and lateral edge surfaces of the middle and bottom layers are respectively uniformly angularly disposed with respect to the bottom surface, the bottom surface area being smaller than the top surface area. The combined thicknesses of said bottom and middle layers may be approximately equal to the thickness of the top layer. The support pad may have only two layers or more than three layers and may also be of one or more layers with each layer exhibiting a continuous gradient of values of indentation force deflections.

In another manner of speaking, a method is provide by the invention for controlling and stabilizing movement of the wrist and forearm of a person while operating a computer mouse or a keyboard by using a foam support pad with a density or indentation force deflection gradient from top to bottom. This gradient may be continuous or it may change abruptly by using multiple layers having at least two specific densities. The gradient indentation force deflection of the foam is such that the bottom of the pad is stable and shock absorbing while the top layer is soft and conforms to the shape of the wrist ore forearm due to the body heat and the weight of the wrist or forearm. This gradient allows the wrist to rest upon the foam pad without causing the fatigue that is normally encountered when the wrist is resting on a normal desk top surface during use of the mouse or keyboard. This action reduces the potential for the user to develop carpal tunnel syndrome from repeated use of the mouse or other in-out device. The stability of the pad also allows the wrist to be stationary so that precise control over the activation of the mouse is achieved, thereby eliminating the common problem of moving the mouse in the micro-second in between double clicking the mouse buttons to activate the pointer on the computer screen.

In a typical application, the foam may be graded so that the bottom layer exhibits an indentation force deflection, as measured by ASTM D3574 Test B1, which is in the approximate range of 488 lbf @ 10° C., 27 lbf @ 21° C. and 9 lbf @ 38° C., so that the middle layer exhibits an indentation force deflection in the approximate range of 315 lbf @ 10° C., 10 lbf @ 21° C. and 7 lbf @ 38° C., and so that the top layer exhibits an indentation force deflection in the approximate range of 34 lbf @ 10° C., 4 lbf @ 21° C. and 3 lbf @ 38° C. Further, in this typical application, the ergonomic support pad may have a total thickness in the approximate range of one to two inches.

A suitable material for purposes of the invention is a product manufactured under the name of CONFOR™ Ergonomic Urethane Foams by E•A•R Specialty Composites Division Cabot Safety Corporation of Indianapolis, Ind. The indentation force deflection gradient can be applied to a range of products for light, medium and heavy weight users. A general shape of the support pad is square, but it may be made to other various shapes to accommodate designers. The pad is preferably flat on the top surface, but it could also be sculpted.

Also, while the initial description above covered the use of three layers, two layers may be acceptable or it may be desirable to have more than three layers.

The combined thickness of the layers for the pad may be in the range of approximately one inch to two inches and the layers may be of different relative thicknesses to achieve an optimum overall design.

Features of the invention include the following:

during use, the support pad may be deformed to allow use in small places and actually wrap around the edge of the desktop or other supporting surface to provide easy use from any desk or computer stand;

while the bottom layer may be of maximum density, nonetheless, it has non-skid characteristics to hold the support pad stationary during use;

the foam material on the top layer easily deforms to accommodate the shape of the wrist or forearm, of substantially any size person, within reason;

multi-layer application makes the use of a mouse or other computer in-out device a comfortable, relaxing experience; and the pad may have a continuous or variable indentation force deflection gradient from top to bottom.

a beveled bottom construction around the periphery of the support pad serves to distribute the force of the wrist and/or forearm into the center of the support pad, minimizing the point load caused by the edge of the support pad.

Additionally, benefits of the invention include the following:

the support pad allows the user to operate a mouse or other in-out device for many hours at a time without suffering from wrist fatigue;

the user can actually feel comfortable while using the support pad so that less productive time will be wasted resting;

the support pad can accommodate substantially any size or weight of individual due to the unique layering composition of the foam of varying indentation force deflections;

an improved level of fine control of the mouse movement or that of other in-out device and button clicking is achieved by the accommodating action of the top layer of the foam material;

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and together with the description, serve to explain the principles of the invention in general terms. Like numerals refer to like parts throughout the disclosure.

DETAILED DESCRIPTION OF THE PREFERRED EMBODIMENTS

Figure 1:
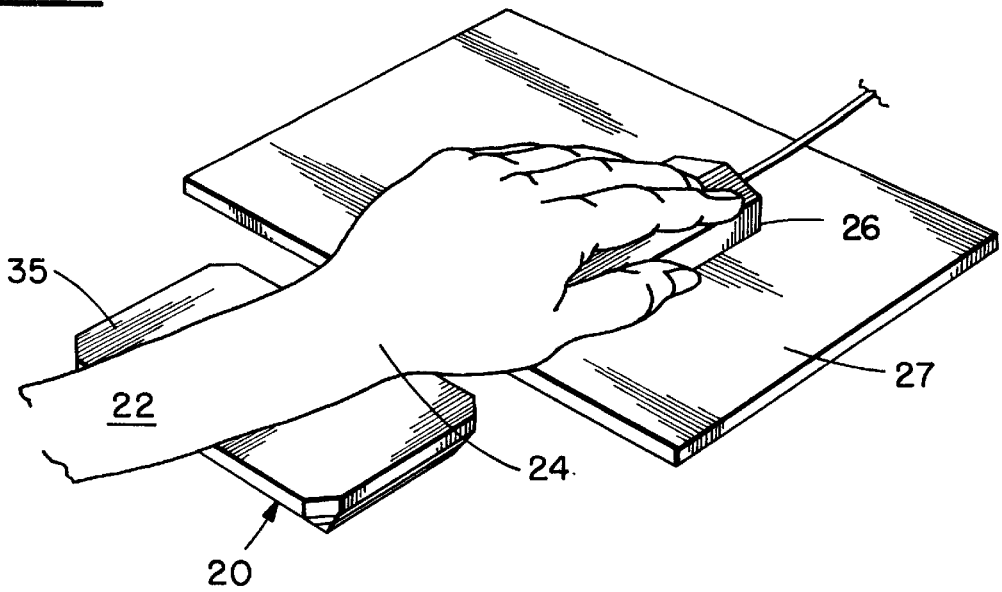
FIG. 1 is a perspective view illustrating the use of the ergonomic support pad of the invention.
Figure 2:
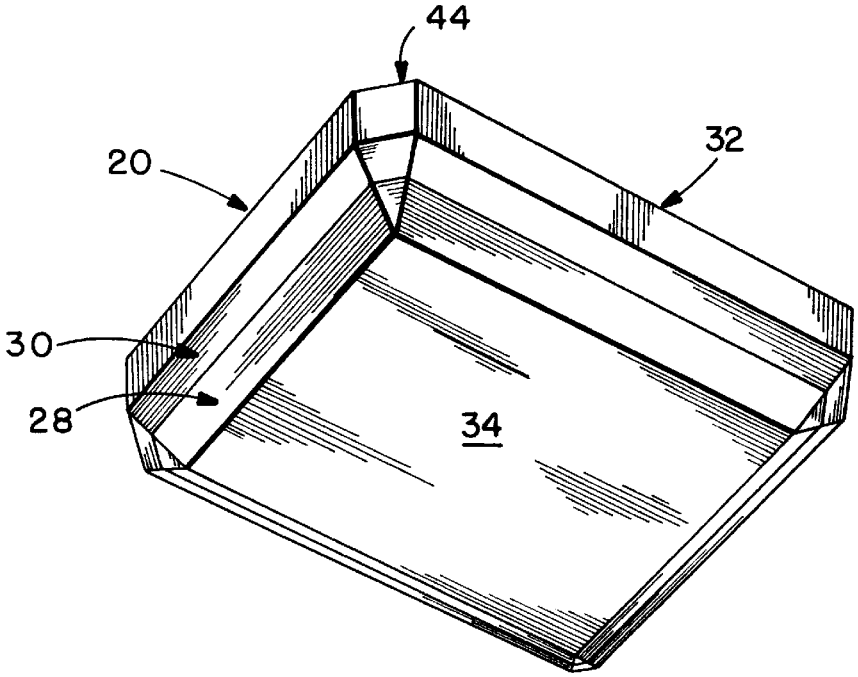
FIG. 2 is a perspective view illustrating only the ergonomic support pad of the invention.
Figure 4:
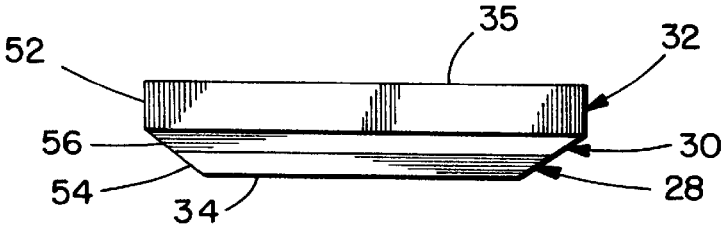
FIG. 4 is a side elevation view of a preferred construction of the ergonomic support pad of the invention.
Figure 3:
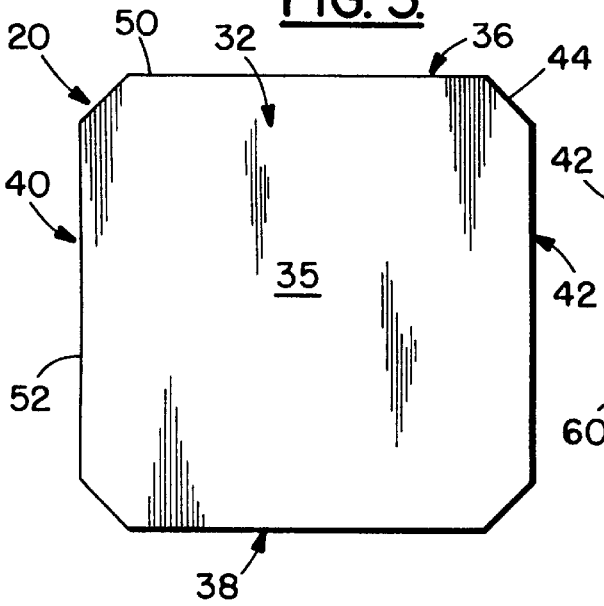
FIG. 3 is a top plan view of the ergonomic support pad of the invention.
Figure 5:
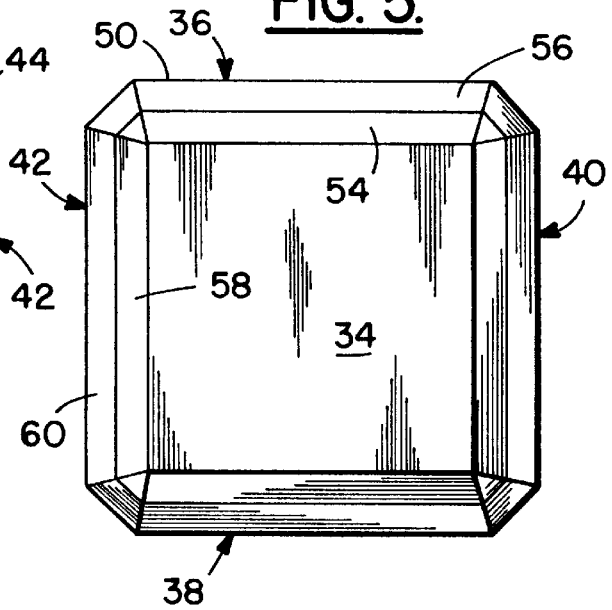
FIG. 5 is a bottom plan view of the ergonomic support pad of the invention.

Turn now to the drawings and, initially, to FIG. 1 which generally illustrates an ergonomic support pad 20 for receiving and supporting the forearm 22 and wrist 24 of a person operating an in-out device 26 for a computer (not shown). The in-out device 26 may be a mouse which is selectively movable across the surface of a mouse pad 27 which customarily has an upper surface with a relatively high coefficient of friction for engagement with the ball or roller of the mouse. As more particularly seen in FIGS. 2, 3, 4, and 5, the support pad 20 comprises bottom, middle, and top layers 28, 30, and 32, respectively, of plastic foam material. The plastic foam material is open celled polyurethane foam material, preferably of the type which softens on contact with a warm surface thereby providing uniform pressure distribution and firm, yet fluid, support. A suitable material for purposes of the invention is a product manufactured under the name of CONFOR™ Ergonomic Urethane Foams by E•A•R Specialty Composites Division, Cabot Safety Corporation of Indianapolis, Ind.

Open celled foam material suitable for purposes of the invention is breathable, non-irritating in dermal contact, and helps dissipate moisture and perspiration away from the body of the user. Each of the layers is of substantially uniform thickness. The bottom layer 28 has a bottom surface 34 for resting on a supporting surface. The top layer 32 is exposed and has a top surface 35 adapted for engageably receiving the forearm 22 and wrist 24 of the person operating the in-out device. The middle layer 30 is intermediate and sandwiched between the bottom layer 28 and the top layer 32.

Each of the layers exhibits an indentation force deflection, as measured by ASTM D3574 Test B1. After performing a substantial investigation, preferred indentation force deflections for the support pad 20 have been determined to be, respectively, for the bottom layer 28: in the approximate range of 488 lbf @ 10° C., 27 lbf @ 21° C. and 9 lbf @ 38° C.; for the middle layer 30: in the approximate range of 315 lbf @ 10° C., 10 lbf @ 21° C. and 7 lbf @ 38° C.; and for the top layer 32: in the approximate range of 34 lbf @ 10° C., 4 lbf @ 21° C. and 3 lbf @ 38° C. The ergonomic support pad 20 preferably has a total thickness in the approximate range of one to two inches.

Figure 6:
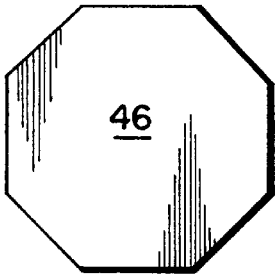
FIG. 6 is a top plan view of another embodiment of the ergonomic support pad of the invention.
Figure 7:
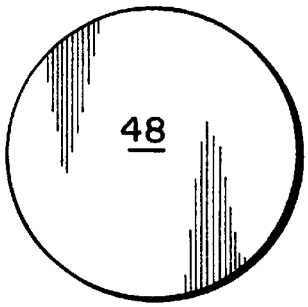
FIG. 7 is a top plan view of still another embodiment of the ergonomic support pad of the invention.

As seen in FIGS. 2–5, the support pad 20 is of substantially quadrilateral shape (see FIG. 3) as seen in plan view having first and second opposed longitudinal surfaces 36, 38, respectively, and first and second opposed lateral surfaces 40, 42 and four corner surfaces 44 being biased and joining, respectively, adjoining pairs of the longitudinal and lateral surfaces. It will be appreciated that the quadrilateral shape may actually be one of a variety of possible shapes including squares, rectangles, and parallelograms. Of course any number of other shapes are also possible, polygonal as indicated by a modified support pad 46 (FIG. 6) and circular as indicated by a modified support pad 48 (FIG. 7).

Returning to FIGS. 2–5, it was earlier mentioned that the support pad 20 has first and second opposed longitudinal edge surfaces 36, 38 and first and second opposed lateral edge surfaces 40, 42 which extend, respectively, from the bottom surface 34 to the top surface 35. As seen particularly well in FIGS. 3 and 4, opposed longitudinal edge surfaces 50 and opposed lateral edge surfaces 52, respectively, of the top layer 32 lie in planes which are substantially perpendicular to the top surface 35. Opposed longitudinal edge surfaces 54, 56 of the middle and bottom layers, 30 and 28, respectively, are uniformly angularly disposed with respect to the bottom surface 34. In similar fashion, opposed lateral edge surfaces 58, 60 of the middle and bottom layers 30, 28, respectively, are uniformly angularly disposed with respect to the bottom surface. The area of the bottom surface 34 is smaller than the area of the top surface 35.

A construction for the support pad 20 resulting in a particularly desirable ergonomic effect has been found to occur when the combined thicknesses of the bottom layer 28 and of the middle layer 30 are approximately equal to the thickness of the top layer 32.

Figure 8:
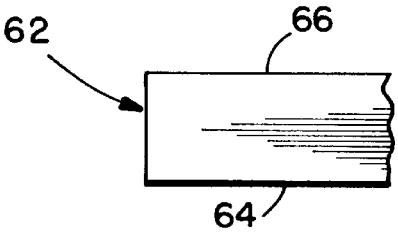
FIGS. 8, 9, and 10 are detail side elevation views, respectively, of still other embodiments of the ergonomic support pad of the invention.

Still another embodiment of the invention is illustrated in FIG. 8 which depicts a modified support pad 62. In the instance illustrated, the support pad has only a single layer of plastic foam material and that single layer has a bottom surface 64 for resting on a supporting surface and a top surface 66 adapted for engageably receiving the forearm 22 and wrist 24 of a person. In this instance, the single layer exhibits a continuous gradient of values of indentation force deflections, as measured by ASTM D3574 Test B1, which are, respectively, adjacent said bottom surface: in the approximate range of 488 lbf @ 10° C., 27 lbf @ 21° C. and 9 lbf @ 38° C., and adjacent said top surface: in the approximate range of 34 lbf @ 10° C., 4 lbf @ 21° C. and 3 lbf @ 38° C., said ergonomic support pad having a total thickness in the approximate range of one to two inches.

Figure 9:
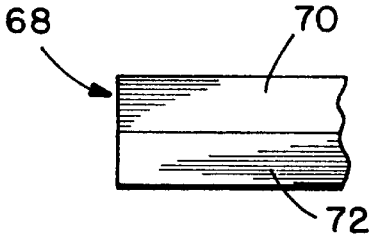

FIG. 9 is similar to FIG. 8 but illustrates a pair of layers 70, 72 suitably bonded together and each exhibits a continuous gradient of values of indentation force deflections.

Figure 11:
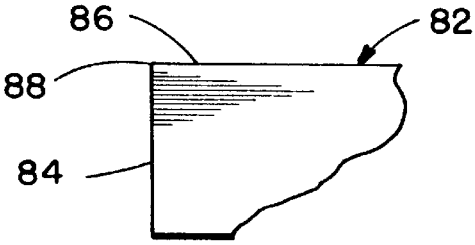
FIG. 11 is a detail top plan view of still another embodiment of the ergonomic support pad of the invention and FIG. 12 is a perspective view illustrating a modified support pad provided for use in association with a keyboard.
Figure 10:
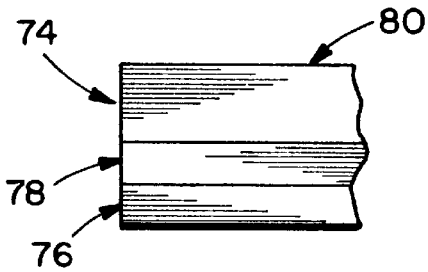

Also, it is preferred that the support pad 20 be peripherally undercut as indicated by the longitudinal edge surfaces 54, 56 and by the lateral edge surfaces 58, 60, previously described. However, viewing FIG. 10, it may be desirable for certain applications that a modified support pad 74 having bottom, middle, and top layers, 76, 78, 80, respectively, be constructed without any such undercut. Similarly, another modified support pad 82 (FIG. 11) does not have corner surfaces 44 on the bias. Rather, adjacent lateral and longitudinal surfaces, 84, 86, respectively, meet at a corner 88.

Figure 12:
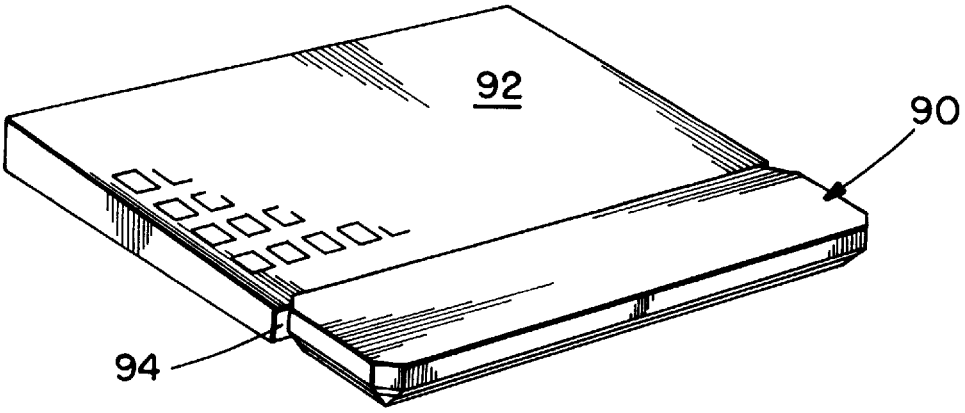
Figure 13:
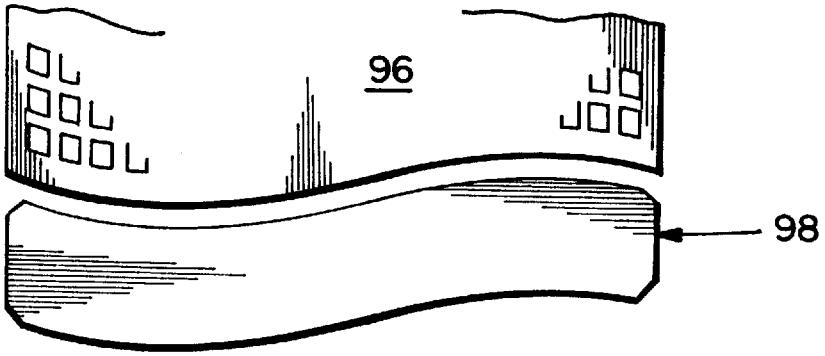
FIG. 13 is a top plan view of a further modified support pad provided for use in association with a keyboard having an irregular shape which is other than rectangular.

It will further be appreciated that the support pad of the invention need not be limited to an in-out device 26 in the nature of a mouse. As seen in FIG. 12, a modified support pad 90 may be provided for use in association, for example, with a keyboard 92 and, for this purpose, would be aligned and in close proximity with and coextensive with a front edge 94 of the keyboard. Additionally, many modern keyboards have irregular shapes, as seen in plan view, that is, other than rectangular. In the instance of a keyboard 96 of such irregular shape, as seen in FIG. 13, it would be desirable to provide a further modified support pad 98 which would be shaped appropriately accordingly.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. An ergonomic support pad for receiving and supporting the forearm and wrist of a person operating an in-out device for a computer comprising:

bottom, middle, and top layers of plastic foam material, each of said layers being of substantially uniform thickness, said bottom layer having a bottom surface for resting on a supporting surface, said top layer being exposed and having a top surface adapted for engageably receiving the forearm and wrist of the person, said middle layer being intermediate and sandwiched between said bottom layer and said top layer, said layers exhibiting indentation force deflections, as measured by ASTM D3574 Test B1, which are, respectively, for said bottom layer: in the approximate range of 488 lbf @ 10° C., 27 lbf @ 21° C. and 9 lbf @ 38° C., for said middle layer: in the approximate range of 315 lbf @ 10° C., 10 lbf @ 21° C. and 7 lbf @ 38° C., and for said top layer: in the approximate range of 34 lbf @ 10° C., 4 lbf @ 21° C. and 3 lbf @ 38° C., said ergonomic support pad having a total thickness in the approximate range of one to two inches.

2. The ergonomic support pad as set forth in claim 1 being of substantially quadrilateral shape as seen in plan view having first and second opposed longitudinal surfaces and first and second opposed lateral surfaces and four corner surfaces being biased and joining, respectively, adjoining pairs of said longitudinal and lateral surfaces.

3. The ergonomic support pad as set forth in claim 1 being of substantially quadrilateral shape as seen in plan view having first and second opposed longitudinal edge surfaces and first and second opposed lateral edge surfaces, said longitudinal edge surfaces and said lateral edge surfaces extending, respectively, from said bottom surface to said top surface, said longitudinal edge surface and said lateral edge surface, respectively, of said top layer lying in planes which are substantially perpendicular to said top surface, said longitudinal and lateral edge surfaces of said middle and bottom layers being respectively uniformly angularly disposed with respect to said bottom surface, the area of said bottom surface being smaller than the area of said top surface.

4. The ergonomic support pad as set forth in claim 1 being composed of open celled polyurethane material.

5. The ergonomic support pad as set forth in claim 1 being composed of open celled polyurethane material of the type which softens on contact with a warm surface thereby providing uniform pressure distribution and firm, yet fluid, support of the person's arm and wrist.

6. The ergonomic support pad as set forth in claim 1 wherein the combined thicknesses of said bottom and middle layers is approximately equal to the thickness of said top layer.

7. The ergonomic support pad as set forth in claim 1 being of substantially quadrilateral shape as seen in plan view having first and second opposed longitudinal edge surfaces and first and second opposed lateral edge surfaces and four corner surfaces being biased and joining, respectively, adjoining pairs of said longitudinal edge and lateral surfaces, said longitudinal edge surfaces and said lateral edge surfaces extending, respectively, from said bottom surface to said top surface, said longitudinal edge surface and said lateral edge surface, respectively, of said top layer lying in planes which are substantially perpendicular to said top surface, said longitudinal and lateral edge surfaces of said middle and bottom layers being respectively uniformly angularly disposed with respect to said bottom surface, the area of said bottom surface being smaller than the area of said top surface.

8. The ergonomic support pad as set forth in claim 1 having a substantially continuous unbroken outer edge surface.

9. The ergonomic support pad as set forth in claim 1 having a substantially continuous unbroken outer edge surface extending from said bottom surface to said top surface, said outer edge surface of said top layer lying in a plane which is substantially perpendicular to said top surface, said outer edge surfaces of said middle and bottom layers being respectively uniformly angularly disposed with respect to said bottom surface, the area of said bottom surface being smaller than the area of said top surface.

10. An ergonomic support pad for receiving and supporting the forearm and wrist of a person operating an in-out device for a computer comprising:

at least bottom and top layers of plastic foam material, each of said layers being of substantially uniform thickness, said bottom layer having a bottom surface for resting on a supporting surface, said top layer being exposed and having a top surface adapted for engageably receiving the forearm and wrist of the person, said layers exhibiting indentation force deflections, as measured by ASTM D3574 Test B1, which are, respectively, for said bottom layer: in the approximate range of 488 lbf @ 10° C., 27 lbf @ 21° C. and 9 lbf @ 38° C. and for said top layer: in the approximate range of 34 lbf @ 10° C., 4 lbf @ 21° C. and 3 lbf @ 38° C., said ergonomic support pad having a total thickness in the approximate range of one to two inches.

11. An ergonomic support pad for receiving and supporting the forearm and wrist of a person operating an in-out device for a computer comprising:

at least a single layer of plastic foam material having a bottom surface for resting on a supporting surface and having a top surface adapted for engageably receiving the forearm and wrist of the person, said single layer exhibiting a continuous gradient of values of indentation force deflections, as measured by ASTM D3574 Test B1, which are, respectively, adjacent said bottom surface: in the approximate range of 488 lbf @ 10° C., 27 lbf @ 21° C. and 9 lbf @ 38° C., and adjacent said top surface: in the approximate range of 34 lbf @ 10° C., 4 lbf @ 21° C. and 3 lbf @ 38° C., said ergonomic support pad having a total thickness in the approximate range of one to two inches.

* * * * *